US012453420B2

(12) United States Patent
Moss et al.

(10) Patent No.: US 12,453,420 B2
(45) **Date of Patent: *Oct. 28, 2025**

(54) MOUNTING BRACKET

(71) Applicant: House of Atlas, LLC, Evanston, IL (US)

(72) Inventors: Jason Moss, Libertyville, IL (US); Alan Arthur Ford, Sturgis, MI (US); Matthew Berman, Chicago, IL (US)

(73) Assignee: House of Atlas, LLC, Evanston, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/770,204

(22) Filed: Jul. 11, 2024

(65) Prior Publication Data

US 2024/0365978 A1 Nov. 7, 2024

Related U.S. Application Data

(63) Continuation of application No. 17/233,309, filed on Apr. 16, 2021, now Pat. No. 12,053,088.

(51) Int. Cl.
*A47B 96/06* (2006.01)
*A47K 10/10* (2006.01)

(52) U.S. Cl.
CPC ..... *A47B 96/06* (2013.01); *A47K 10/10* (2013.01); *A47K 2201/025* (2013.01)

(58) Field of Classification Search
CPC ..... A47B 96/06; A47K 10/22; A47K 2201/025; A47K 10/10
See application file for complete search history.

(56) References Cited

U.S. PATENT DOCUMENTS

| | | | | |
|---|---|---|---|---|
| 912,789 A | | 2/1909 | Berbecker | |
| 1,044,893 A | | 11/1912 | Lathrop | |
| 3,036,803 A | | 5/1962 | Fiebelkorn | |
| 3,516,635 A | | 6/1970 | De Neit | |
| 4,718,625 A | | 1/1988 | Boda | |
| 4,979,713 A | * | 12/1990 | Bell | A47K 10/10 248/221.11 |
| 5,121,893 A | | 6/1992 | King | |
| 6,146,159 A | | 11/2000 | Brunker | |

(Continued)

OTHER PUBLICATIONS

Delta "Easy Clip" Concept video. <https://www.homedepot.com/p/Delta-Silverton-Towel-Ring-in-Brushed-Nickel-SLV46-SN/203011170>, believed to be publicly available at least as of Apr. 16, 2021.

(Continued)

*Primary Examiner* — Ko H Chan
(74) *Attorney, Agent, or Firm* — Fitch, Even, Tabin & Flannery LLP

(57) ABSTRACT

A mounting bracket is provided that includes a plate having a mounting hole for attachment to a surface. The mounting bracket includes a hooking portion attached to the plate for supporting a hardware mounting component. The mounting bracket further includes a biasing member attached to the plate and biasing a tab of the biasing member to a first position for engagement with the hardware mounting component to secure the hardware mounting component to the plate. The tab of the biasing member is movable to a second position where the tab does not engage the hardware mounting component.

21 Claims, 4 Drawing Sheets

(56) References Cited

U.S. PATENT DOCUMENTS

| | | | | |
|---|---|---|---|---|
| 6,186,457 | B1 | 2/2001 | Carter | |
| 6,540,187 | B2 | 4/2003 | Carter | |
| 6,810,538 | B2 | 11/2004 | Ouyoung | |
| 7,410,135 | B1 | 8/2008 | Dibble | |
| 7,703,500 | B2 | 4/2010 | Wen | |
| 8,430,369 | B2 * | 4/2013 | Hsu | A47K 10/04 248/221.11 |
| 8,646,626 | B2 | 2/2014 | Hsu | |
| 9,307,124 | B2 | 4/2016 | Chen | |
| 9,339,153 | B1 * | 5/2016 | Chang | A47K 10/12 |
| 9,839,332 | B2 * | 12/2017 | Austin, III | A47K 10/04 |
| 10,123,664 | B2 | 11/2018 | Jones | |
| D839,632 | S | 2/2019 | Downey | |
| 10,533,699 | B2 | 1/2020 | Yang | |
| 10,634,280 | B2 | 4/2020 | Garcia | |
| 10,663,104 | B2 | 5/2020 | Yang | |
| 10,673,999 | B2 | 6/2020 | Yang | |
| 11,143,360 | B2 | 10/2021 | Brownstone | |
| 12,053,088 | B2 | 8/2024 | Moss | |
| 2006/0070966 | A1 | 4/2006 | Koudys | |
| 2012/0067837 | A1 * | 3/2012 | He | A47K 10/10 211/1 |
| 2012/0119046 | A1 | 5/2012 | Hsu | |
| 2014/0026402 | A1 | 1/2014 | Austin, III | |
| 2016/0134770 | A1 | 5/2016 | Sato | |
| 2018/0283604 | A1 | 10/2018 | Garcia | |
| 2020/0132249 | A1 | 4/2020 | Brownstone | |
| 2020/0318782 | A1 | 10/2020 | Garcia | |
| 2022/0330697 | A1 | 10/2022 | Moss | |

OTHER PUBLICATIONS

Pfister Karci product as shown in the this video. <https://www.youtube.com/watch?v=bGubTxCVOS8>, believed to be publicly available at least as of Apr. 16, 2021.

* cited by examiner

MOUNTING BRACKET

CROSS-REFERENCE TO RELATED APPLICATION

This application is a continuation of U.S. application Ser. No. 17/233,309, filed Apr. 16, 2021, which is hereby incorporated herein by reference in its entirety.

FIELD

This disclosure relates to mounting brackets and, in particular, to mounting brackets for wall mounted hardware.

BACKGROUND

Many bathrooms include hardware mounted to the wall or door such as towel bars, towel rings, toilet paper holders, and robe hooks. Current solutions are prone to coming detached from the wall with use or are difficult and cumbersome to install. Homeowner's installing bathroom hardware desire bathroom hardware that can be easily installed and remain firmly secured to the wall during use.

DETAILED DESCRIPTION

Figure 1:
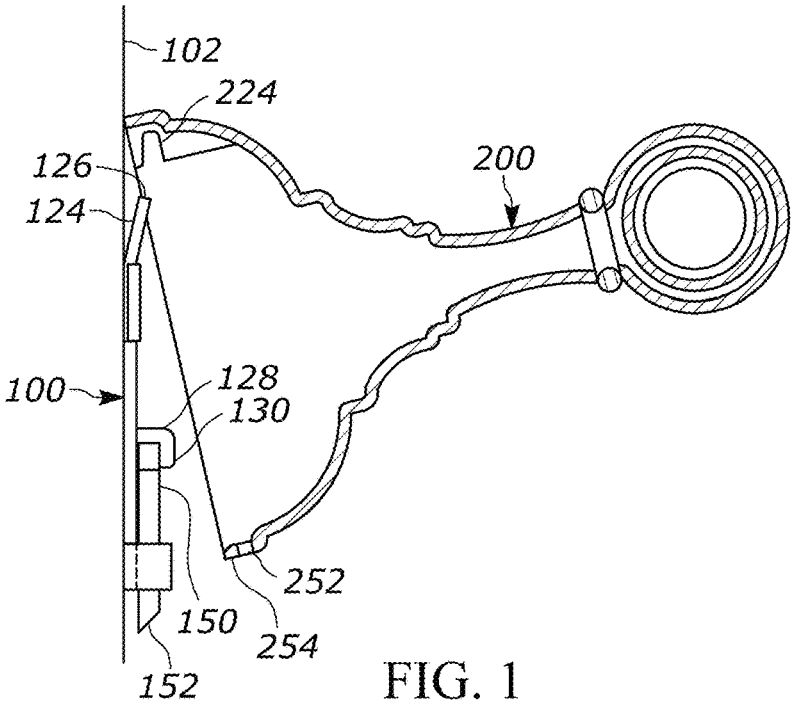
FIG. 1 is a cross-sectional side view of a mounting bracket and a hardware component.

With respect to FIG. 1 a mounting bracket 100 is shown that is configured to be attached to a wall 102. The mounting bracket 100 enables a hardware mounting component 200 to be easily affixed to the wall 102. Once the mounting bracket 100 is attached the wall, the hardware mounting component 200 may be attached to the mounting bracket 100 by guiding a tongue 124 of the mounting bracket 100 into a corresponding recess 224 of the hardware mounting component 200. The hardware mounting component 200 may then be pivoted about the tongue 124 to engage and cause a moveable tab 152 of a biasing member 150 of the mounting bracket 100 to snap into an opening 252 of the hardware mounting component 200. The hardware mounting component 200 is then securely affixed to the wall. To detach the hardware component, force is applied to the tab 152 of the biasing member 150 to withdraw the tab 152 from the opening 252 of the hardware component, allowing the hardware mounting component 200 to be pivoted away from the wall 102 and removed.

Figure 2:
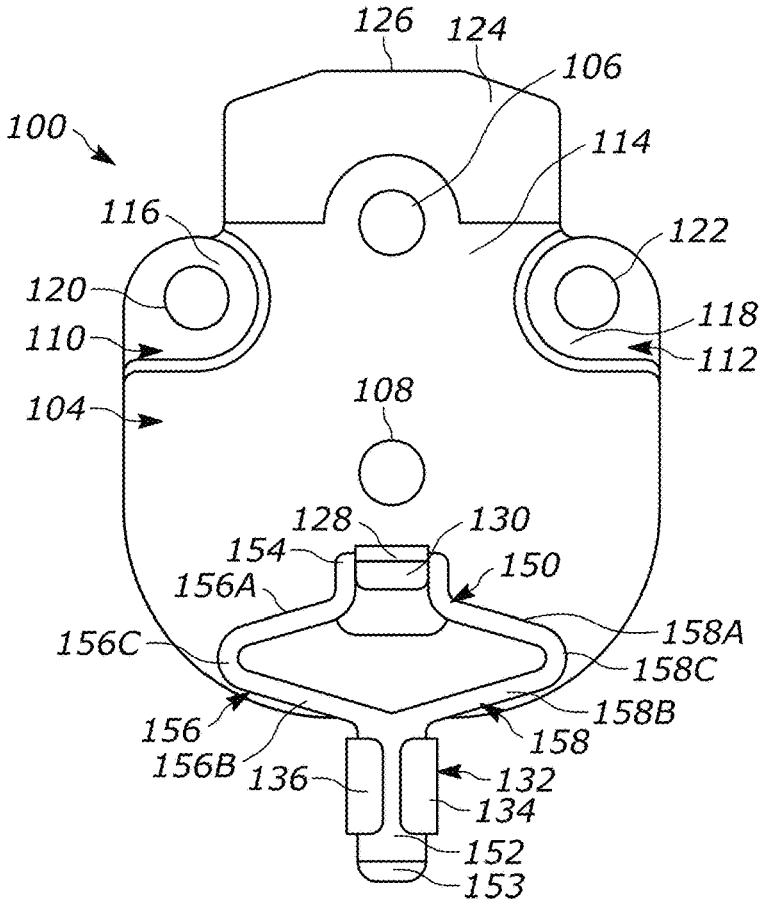
FIG. 2 is a front elevation view of the mounting bracket of FIG. 1.
Figure 3:
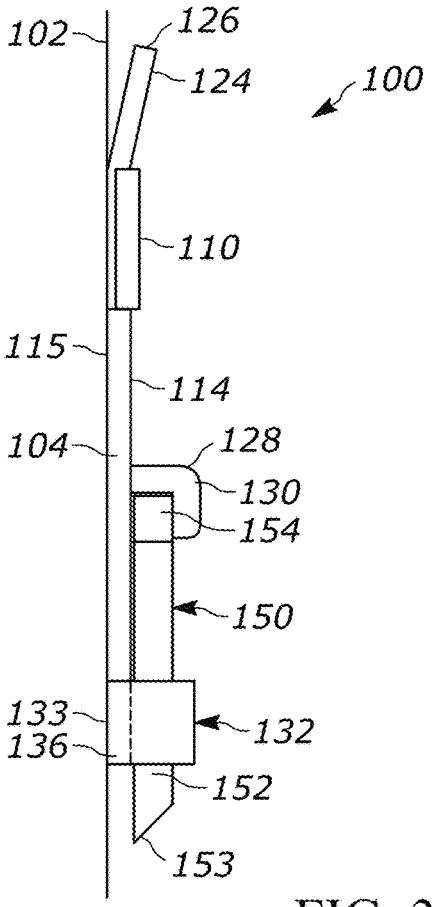
FIG. 3 is a side elevation view of the mounting bracket of FIG. 1.

With respect to FIGS. 2-3, the mounting bracket 100 includes a plate 104 having a front surface 114 and a rear surface 115 for engaging the wall 102 when the plate 104 is mounted to the wall 102. The plate 104 may be made of metal and may be formed by a die cut. The plate 104 defines an upper hole 106 and a lower hole 108. Fasteners may be extended through the upper hole 106 and the lower hole 108 and into the wall 102 to affix the mounting bracket 100 to the wall 102.

The plate 104 further includes a left platform 110 and a right platform 112 protruding from the front surface 114 of the plate 104. The left platform 110 and the right platform 112 include respective planar surfaces 116, 118 that are substantially parallel to the front surface 114 of the plate 104. The left platform 110 defines a hole 120 and the right platform defines hole 122. Fasteners may be extended through the holes 120 and 122 to affix the mounting bracket 100 to the wall 102. The rear surfaces of each of the platforms 110, 112 may be substantially planar. In the embodiment shown, the rear surfaces 110, 112 are not aligned with the rear surface 115 of the plate but are shifted to extend outward of the front surface 114 of the plate 104. The platforms 110, 112 may be formed by stamping the plate 104. When the rear surface 115 of the plate 104 is positioned against the wall 102, the rear surfaces 110, 112 of the plate 104 are spaced apart from the wall 102. This provides space for wall anchors to protrude out of the wall 102 slightly without affecting how the plate 104 engages the wall 102. For instance, the rear surface 115 may be brought fully into engagement with the wall 102 without a wall anchor spacing the plate 104 from the wall 102. This enables the plate 104 to be mounted completely flush with the wall 102 via fasteners.

The tongue 124 of the plate 104 extends obliquely to the planar surface 114 of the plate 104. When the plate 104 is attached to the wall 102 via fasteners, an end 126 of the tongue 124 is spaced from the wall 102 enabling a portion of the hardware mounting component 200 to hook the tongue 124 for attachment thereto.

The biasing member 150 of the mounting bracket 100 includes a base portion 154, the tab 152, and two opposed V-shaped legs 156, 158 extending in parallel from the base portion 154 to the tab 152 for balance. Leg 156 includes a first portion 156A connected to a second portion 156B at an elbow 156C to form the V-shape. Leg 158 similarly includes a first portion 158A connected to a second portion 158B at an elbow 158C to form the V-shape. As shown, the first portion 156A of the first leg 156 and the first portion 158A of the second leg 158 extend from the base portion 154 at an angle and away from one another. The second portion 156B of the first leg 156 extends from the elbow 156C back toward the second leg 158 to the tab 152 and the second portion 158B of the second leg 158 extends from the elbow 158C back toward the first leg 156 to the tab 152.

The biasing member 150 is formed of a flexible, elastic material enabling a force to be applied to the tab 152 to move the tab 152 longitudinally toward the base portion 154. This force causes the legs 156, 158 to bend at the elbows 156C and 158C, causing the first portion 156A of leg 156 to move toward the second portion 156B of leg 156 and the first portion 158A of leg 158 to move toward the second portion 158B of leg 158. This results in the tab 152 moving closer to the base portion 154. Due to the elasticity of the biasing member 150, when the force is removed from the tab 152, the legs 156, 158 will elastically return to their original form, causing the tab 152 to return to its original longitudinal position relative to the base portion 154.

While the biasing member 150 of the embodiment shown includes opposing V-shaped legs 156, 158 to provide the biasing force, other biasing elements may also be used. As one example, a helical spring may extend from the tab 152 to the base 154.

The plate 104 includes a tab 128 extending transversely relative the front surface 114. The base portion 154 of the biasing member 150 abuts the tab 128. When force is applied to the tab 152 of the biasing member 150 to force the biasing member 150 in the longitudinal direction, the base portion 154 engages the tab 128 and prevents the biasing member 150 from moving beyond the tab 128. The tab 128 serves to anchor the biasing member 150.

The biasing member 150 further pushes against the tab 128 to force the tab 152 of the biasing member 152 away from the base portion 154 when the force is no longer applied. The end portion 130 of the tab 128 of the plate 104 is bent to extend in the longitudinal direction and over the base portion 154 of the biasing member 150. The end portion 130 prevents the base portion 154 of the biasing member 150 from moving transversely relative to the base portion 154. In some forms, the end portion 130 of the tab 128 may be bent such that the tab 130 hooks the biasing member 150 to prevent the biasing member 150 from moving substantially relative to the tab 128. The tab 128 may be stamped from the plate 104 and configured as described above.

The plate 104 further includes a guide channel 132 at the lower end of the plate 104. The guide channel 132 if formed by an axially extending portion 133 of the plate 104 and two tabs 134, 136 extending transversely away from the axial extending portion 133 in the same direction as the tab 128. The ends of the tabs 134, 136 are bent to extend toward one another to form the guide channel 132. The guide channel 132 is sized such that the tab 152 of the biasing member 150 reciprocates in the channel 132. The tab 128 and the guide channel 132 are positioned such that a tip 153 of the tab 152 extends beyond the end of the channel 132 when in a relaxed configuration. This enables the tab 152 to extend beyond the lower edge of the plate 104 and into the opening 252 of the hardware mounting component 200 that is mounted to the mounting bracket 100. The guide channel 132 aids to guide the tab 152 of the biasing member 150 in the longitudinal direction when force is applied to the tab 152 or when the biasing member 150 is returning to its relaxed configuration when force is no longer being applied.

As shown in FIG. 3, the tab 152 includes an angled tip 153. The angled tip 153 aids to attach the hardware mounting component 200. During installation, when the lower edge 254 of the hardware mounting component 200 is brought toward the wall 102 to cause the tab 152 to be inserted into the opening 252, the edge 254 of the hardware component engages the angled tip 153 which forces the tab 152 to move longitudinally toward tab 128 compressing the biasing member 150. The lower edge 254 of the hardware mounting component 200 is brought closer toward the wall 102 until the tip 153 passes over the opening 252, at which point the tab 152 springs into the opening 252 due to the relaxation of the biasing member 150.

Figure 4:
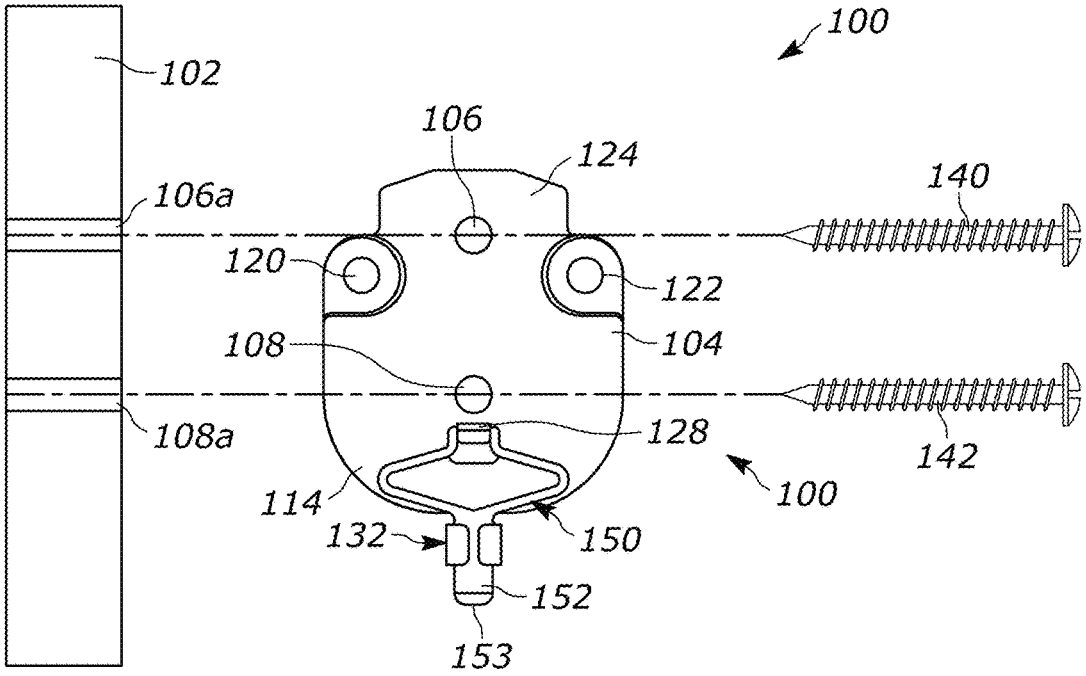
FIG. 4 illustrates the attachment of the mounting bracket of FIG. 1 to a wall according to a first configuration.

The mounting plate 100 may be affixed to a surface, such as a wall 102, via the holes 106, 108 and/or holes 120, 122. As shown in FIG. 4, the mounting plate 100 is secured to the wall via fasteners 140, 142, such as screws, that extend through holes 106, 108, respectively. The mounting plate 100 may be secured to a wall via the holes 106, 108 when the holes 106, 108 overlie a stud or wood frame of the wall 102. To attach the mounting plate 100 via the holes 106, 108, a pilot hole 106A may be drilled into the wall 102 at the position where it is desired the hole 106 of the mounting bracket 100 be positioned on the wall 102. Likewise, a pilot hole 108A may be drilled into the wall 102 where it is desired that the hole 108 be positioned on the wall 102. The holes 106 and 108 of the plate 104 may be arranged such that when the holes 106, 108 are aligned with the vertical direction, the mounting plate 100 will be square with the walls of the room. Thus, when mounting the mounting plate 100, one can determine that holes 106, 108 are aligned with the vertical direction, enabling the mounting bracket 100 to be mounted consistently such that the hardware mounting component 200 is positioned predictably on the wall 102 when attached to the mounting bracket 100.

To secure the mounting bracket 100 to the wall 102, the fastener 140 may be inserted through the hole 106 from the front surface 114 and into the pilot hole 106A. The fastener 142 may also be inserted through the hole 108 on the front surface 114 and into the pilot hole 108A. Once the fasteners are fully tightened, the mounting bracket 100 is secured to the wall 102.

Figure 5:
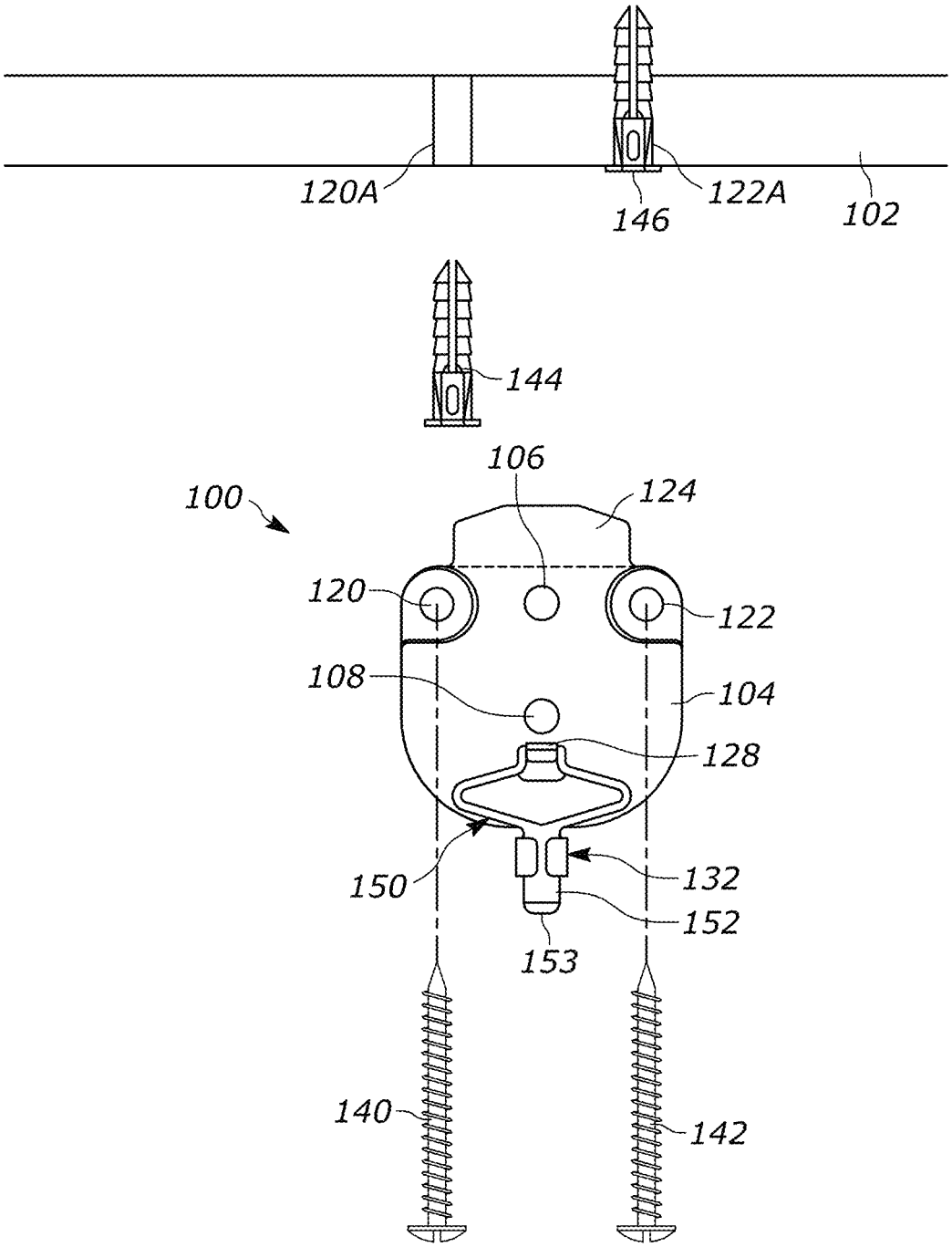
FIG. 5 illustrates the attachment of the mounting bracket of FIG. 1 to a wall according to a second configuration.

With respect to FIG. 5, the mounting bracket 100 may be mounted to a surface, such as the wall 102, via a second approach using the holes 120, 122. The wall 102 may be formed in part of drywall or plaster as examples. Two pilot holes 120A, 122A may be drilled into the wall 102 where it is desired that holes 120, and 122 be positioned on the wall 102. The holes 120, 122 may be used to mount the mounting bracket 100 to the wall 102 when it is desired to mount the hardware mounting component 200 to a location on the wall 102 that does not include a stud or wooden frame within the wall 102. Where the pilot holes 120A, 122A are not drilled into a wooden frame or stud, anchors 144, 146 may be inserted into the pilot holes 120A, 122A.

The holes 120, 122 may be arranged on the plate 104 such that when the holes 120, 122 are horizontally aligned, the mounting bracket 102 will be square with the walls of the room, enabling the mounting bracket 100 to be mounted consistently so that the hardware mounting component 200 is positioned predictably on the wall 102. Having the holes 120, 122 positioned toward the top end of the plate 104 with a longitudinal length of the plate 104 engaging the wall 102 below the holes 120, 122 when mounted to the wall 102 enables the mounting bracket 100 to support a greater amount of weight as described in U.S. application Ser. No. 16/749,770 which is hereby fully incorporated by reference. This configuration enables the mounting bracket 100 to support a greater amount of weight without pulling the anchors 144, 146 out of the wall 102 or otherwise damaging the wall 102.

To secure the mounting bracket 100 to the wall 102, the fastener 140 may be inserted through the hole 120, from the front surface 114 and into the pilot hole anchor 144 inserted into the pilot hole 120A. The fastener 142 may also be inserted through hole 122 on the front surface 114 and into the anchor 146 inserted into the pilot hole 122A. Once the fasteners 140, 142 have been fully tightened into the anchors 144, 146 the mounting bracket is secured to the wall 102.

In some forms, users may secure the mounting bracket 100 to the wall 102 using any number of holes 106, 108, 120, 122 by extending a fastener through the holes and into the wall 102. In some forms, all four holes 106, 108, 120, 122 may be used combining the two approaches described with regard to FIGS. 4 and 5.

Figure 6:
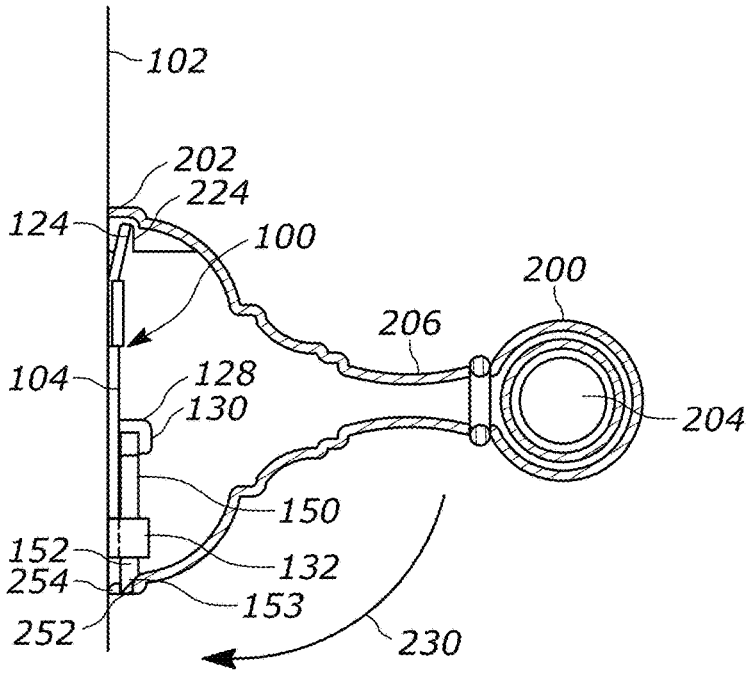
FIG. 6 is a cross-sectional side view similar to that of FIG. 1 with the hardware component attached to the mounting bracket.

Once the mounting bracket 100 has been secured to the wall 102, the hardware mounting component 200 may be attached to the mounting bracket 100. As shown in FIG. 1, the hardware mounting component 200 may include a recess 224 for receiving the tongue 124 of the mounting bracket 100. The hardware mounting component 200 may be positioned to align the tongue 124 with the recess 224 of the hardware mounting component 200. The hardware mounting component 124 may be moved downward to bring the tongue 124 of the mounting bracket 100 into the recess 224. As shown in FIG. 6, once the tongue 124 is within the recess 224, the hardware mounting component 200 may be pivoted in the direction 230 about the tongue 124 to bring the lower end of the hardware mounting component 200 toward the wall 102. Once the lower edge 254 of the hardware mounting component 200 engages the angled tip 153 of the biasing element 150, the biasing element 150 is forced upward and over the lower edge 254. Once the opening 252 of the hardware mounting component 200 is aligned with the tab 152 of the biasing element 150, the biasing element 150 springs back toward its relaxed position with the tab 152 positioned within the opening 252, thereby inhibiting the lower edge 254 of the hardware mounting component 200 from being pivoted away from the wall 102. The hardware mounting component 200 is thus secured to the wall 102 via the mounting bracket 100. The hardware mounting component 200 may include a base 202 sized to cover the mounting bracket 100 when secured thereto.

To remove the hardware mounting component 200 from the wall 102, the tab 152 of the biasing element 150 is forced toward the tab 128 of the mounting bracket 128 and out of the opening 252. This may be done by, for example, extending a screwdriver or fingernail through the opening 252 to engage the tab 152 and compress the biasing element 150. While the tab 152 is forced out of the opening 152, the hardware mounting bracket 200 may be pivoted away from the wall about the tongue 124 of the mounting bracket 100. The hardware mounting component 200 may then be lifted off the mounting bracket 100 to withdraw the tongue 124 from the recess 224 of the hardware mounting component 200.

Figure 7:
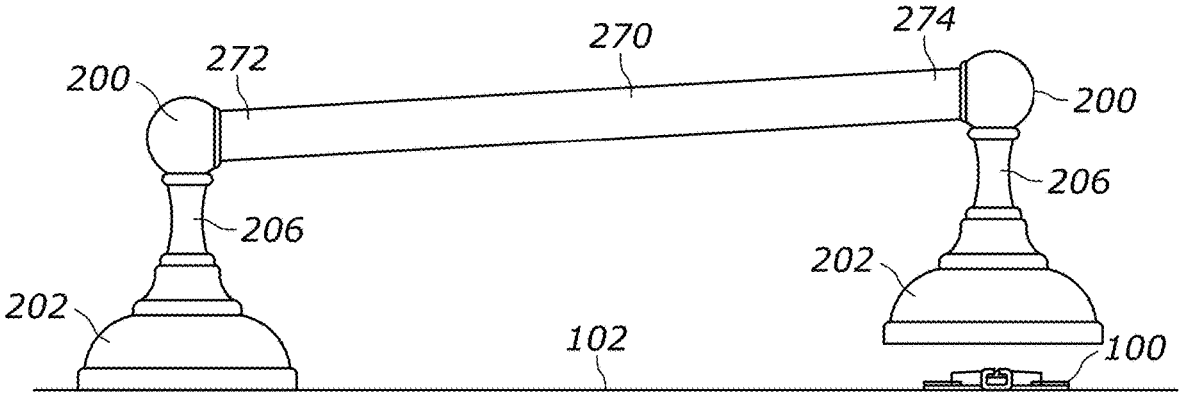
FIG. 7 illustrates an example application of the mounting bracket of FIG. 1 used to mount a towel bar to a wall.

FIG. 7 illustrates an example application where two mounting brackets 100 are used to attach a towel bar to the wall 102. In this example, the hardware mounting components 200 are posts that are attached to the wall 102 and support a rod 270 extending between the two posts. As shown the hardware mounting components 200 or posts include a base 202, a recess 204 (FIG. 6) for receiving an end of the bar 270, and an arm 206 extending from the base 202 to the recess 204. Two mounting brackets 100 are secured to the wall 102 as described above at the locations where the first and second posts of the towel bar are to be positioned on the wall 102. The first hardware mounting component 200 or post is attached to a first of the mounting brackets 100 as described above with the recess 204 opening toward the other mounting bracket 100. A first end 272 of the bar 270 is inserted into the recess 204 of the hardware mounting component 200 secured to the wall 102. A second end 274 of the bar 270 is inserted into the recess 204 of the second hardware mounting component 200. The second hardware mounting component 200 is then attached to the mounting bracket 100 as described above. The bar 270 is then supported between the two posts or hardware mounting components 200 secured to the wall 102. The towel bar may then be used, for example, to support towels for drying.

While an example application of the mounting plate 100 has been given, those having skill in the art will readily appreciate that the hardware mounting component 200 may be or include the base of a towel ring, robe hook, toilet paper holder, towel hook, and other wall mounted hardware components.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A mounting bracket comprising:

a plate defining a first mounting hole for attachment to a surface;

a hooking portion extending from the plate;

a hardware mount pivotable about the hooking portion;

a latch associated with the plate and comprising a biasing portion and an elongated tab portion extending from the biasing portion, the biasing portion having a first portion fixed relative to the plate and a second portion supporting the tab portion, the tab portion having a lock position where the tab portion interconnects with the hardware mount to secure the hardware mount against movement relative to the plate and an install position where the tab portion is moved against the biasing of the biasing portion to allow the hardware mount to move relative to the plate;

the tab portion includes a first end connected to the biasing portion and a second end positioned to engage the hardware mount during attachment to cause the tab portion to move toward the install position as the hardware mount is engaged with and pivoted against the hooking portion into engagement with the second end of the tab portion, and the tab portion returning to the lock position as the hardware mount is pivoted further about the hooking portion; and a connector attaching the biasing portion to the plate, the connector wrapping around at least in part the first portion of the biasing portion.

2. The mounting bracket of claim 1 further comprising a guide limiting movement of the tab portion as the tab portion moves between the lock position and the install position and preventing the biasing portion from entering the guide.

3. The mounting bracket of claim 1 wherein the plate includes an anchoring tab to attach the first portion of the biasing portion to the plate.

4. The mounting bracket of claim 3 wherein the anchoring tab extends in part toward the second portion of the biasing portion to form a recess receiving the first portion of the biasing portion.

5. The mounting bracket of claim 1 wherein the biasing portion includes opposing legs extending from the first portion to the second portion of the biasing portion.

6. The mounting bracket of claim 5 wherein the opposing legs are symmetrical.

7. The mounting bracket of claim 1 wherein the plate further defines a second mounting hole, the first mounting hole and the second mounting hole being aligned parallel to a longitudinal dimension of the plate.

8. The mounting bracket of claim 1 wherein the plate further defines a second mounting hole, the first mounting hole and the second mounting hole being aligned perpendicular to a longitudinal dimension of the plate.

9. The mounting bracket of claim 1 wherein the plate defines a first plane to engage a mounting surface, the plate includes a first attachment portion defining the first mounting hole and a second attachment portion defining a second mounting hole, and the first attachment portion and the second attachment portion defining a second plane parallel to the first plane such that when the plate engages the mounting surface the first and second attachment portions are spaced from the mounting surface.

10. The mounting bracket of claim 1 wherein the second end of the tab portion is angled so that the hardware mount slides against the second end to move the tab portion to the install position.

11. A hardware system comprising a rod and a mounting bracket of claim 1 for supporting the rod.

12. A mounting bracket comprising:

a plate defining a mounting hole for attachment to a surface;

a hooking portion extending from the plate for supporting a hardware mount;

a latch attached to the plate, the latch including a biasing element and a tab, the biasing element supporting the tab which extends therefrom in a longitudinal direction, the biasing element biasing the tab to a first position for insertion into a receiving portion of the hardware mount, the tab movable to a second position where the tab is withdrawn from the receiving portion of the hardware mount while the hardware mount is supported by the hooking portion; and a guide defining opposing channels extending in the longitudinal direction and sized to receive the tab and to guide the tab as the tab moves longitudinally between the first and second positions, wherein the guide is sized to prevent the biasing element from entering the opposing channels.

13. The mounting bracket of claim 12 wherein the biasing element includes a base and opposing legs extending from the base to the tab.

14. The mounting bracket of claim 12 wherein the opposing channels extends in the longitudinal direction from the plate.

15. The mounting bracket of claim 12 wherein the plate includes an anchoring tab that the biasing element engages when biasing the tab toward the first position, the latch being associated with the plate by the anchoring tab and the guide.

16. The mounting bracket of claim 15 wherein an end of the anchoring tab extends about at least a portion of the biasing element to limit movement of the latch relative to the plate.

17. A mounting bracket comprising:

a plate defining a mounting hole for attachment to a surface;

a hooking portion extending from the plate for supporting a hardware mount;

a latch attached to the plate, the latch including a biasing element and a tab, the biasing element supporting the tab which extends therefrom in a longitudinal direction, the biasing element biasing the tab to a first position for insertion into a receiving portion of the hardware mount, the tab movable to a second position where the tab is withdrawn from the receiving portion of the hardware mount while the hardware mount is supported by the hooking portion; and a guide defining a guide channel extending in the longitudinal direction and sized to receive the tab and to guide the tab as the tab moves longitudinally between the first and second positions, wherein the guide is sized to prevent the biasing element from entering the guide channel, wherein the tab is positioned to be manually moved toward the second position to withdraw the tab from the receiving portion of the hardware mount.

18. The mounting bracket of claim 12 wherein the tab and the biasing element are a single piece.

19. The mounting bracket of claim 12 wherein the mounting hole of the plate includes a first pair of mounting holes aligned parallel to the longitudinal direction.

20. The mounting bracket of claim 12 wherein the mounting hole of the plate includes a first pair of mounting holes aligned perpendicular to the longitudinal direction.

21. The mounting bracket of claim 12 wherein the plate defines a first plane to engage a surface for mounting, the plate includes a first attachment portion defining the first mounting hole and a second attachment portion defining a second mounting hole, and the first attachment portion and the second attachment portion defining a second plane parallel to the first plane such that the first and second attachment portions are spaced from the mounting surface.

* * * * *